US006181361B1

(12) United States Patent
Bluteau et al.

(10) Patent No.: US 6,181,361 B1
(45) Date of Patent: Jan. 30, 2001

(54) DEVICE FOR THERMAL PRINTING OF A ROLLED PAPER STRIP, IN PARTICULAR FOR A PLUG-IN OR CORDLESS PORTABLE PAYMENT TERMINAL

(75) Inventors: Bernard Bluteau, Chatenay-Malabry; Jean-Louis Cariou, Roissey en Brie, both of (FR)

(73) Assignee: Dassault Automatismes et Telecommunications, Plaisir (FR)

( * ) Notice: Under 35 U.S.C. 154(b), the term of this patent shall be extended for 0 days.

(21) Appl. No.: 09/358,963

(22) Filed: Jul. 22, 1999

(30) Foreign Application Priority Data

Jul. 22, 1998 (FR) ..... 98 09372

(51) Int. Cl.[7] ..... B41J 15/04
(52) U.S. Cl. ..... 347/222; 400/613; 400/693
(58) Field of Search ..... 347/222; 400/691, 400/693, 613, 594

(56) References Cited

U.S. PATENT DOCUMENTS

| | | | | |
|---|---|---|---|---|
| 4,477,305 | | 10/1984 | Hamisch, Jr. et al. | 156/384 |
| 4,478,145 | | 10/1984 | Mistyurik | 101/205 |
| 5,110,226 | * | 5/1992 | Sherman et al. | 347/222 |
| 5,201,588 | * | 4/1993 | Sakai et al. | 347/222 |
| 5,411,342 | | 5/1995 | Horie et al. | 400/613 |
| 5,486,062 | | 1/1996 | Tsurumaru | 400/618 |

FOREIGN PATENT DOCUMENTS

| | | |
|---|---|---|
| 0 416 960 A1 | 3/1991 | (EP) . |
| 0 505 973 A2 | 9/1992 | (EP) . |
| WO98/15929 | 4/1998 | (WO) . |

* cited by examiner

*Primary Examiner*—Huan Tran
(74) *Attorney, Agent, or Firm*—Christie, Parker & Hale, LLP

(57) ABSTRACT

A device for thermal printing of a rolled paper strip has a frame of which a fixed part comprises two lateral cheeks, which are perpendicular to an axis of articulation of a cover, and each comprise on their inner side fixed articulation means. The cover comprises two discs, which are accommodated between the two fixed cheeks, and each comprise on their outer side mobile articulation means which cooperate with the fixed articulation means. A latch, which is articulated around an axis which is parallel to the axis of articulation of the cover, cooperates with the cover and the fixed part of the frame, in order to provide locking/unlocking of the paper compartment on the fixed part of the frame.

13 Claims, 7 Drawing Sheets

DEVICE FOR THERMAL PRINTING OF A ROLLED PAPER STRIP, IN PARTICULAR FOR A PLUG-IN OR CORDLESS PORTABLE PAYMENT TERMINAL

BACKGROUND OF THE INVENTION

The present invention relates to a device for thermal printing of a rolled paper strip, in particular for a plug-in or cordless portable payment terminal.

It applies generally to thermal printing of a rolled paper strip which is designed to be unwound in front of a thermal print head, by means of a paper drive roller, and to be cut into sections in order to form a payment authorisation or the like.

Many thermal printing devices are known, of the type which comprise a frame, which contains a fixed part which can support the thermal print head, and a mobile part which forms a cover for access to a paper compartment, and is articulated around an axis which is parallel to the drive axis of the paper strip.

When this type of printing device is that of a (plug-in or cordless) portable payment terminal, the paper compartment is often articulated in a fragile manner relative to the fixed frame, which gives rise to substantial damage, in particular when the portable payment terminal is dropped or banged.

The applicant has undertaken to solve the problem of eliminating this disadvantage.

Thus, the object of the present invention is to provide a thermal printing device, in particular for a (plug-in or cordless) portable payment terminal, in which the paper compartment is articulated integrally relative to the fixed frame.

The present invention relates to a thermal printing device for a rolled paper strip, in particular for a portable payment terminal, the said paper strip being designed to be unwound in front of a thermal print head, by means of a paper drive roller, and to be cut into sections in order to form a payment authorisation or the like, the printing device being of the type which comprises a frame, which contains a fixed part which can support the thermal print head, and a mobile part which forms a cover for access to a paper compartment, and is articulated around an axis which is parallel to the drive axis of the paper strip.

SUMMARY OF THE INVENTION

According to a general definition of the invention, the fixed part of the frame comprises two lateral cheeks, which are spaced from one another, parallel to one another, perpendicular to the axis of articulation of the cover, and each comprise on their inner side fixed articulation means, the two lateral cheeks being connected partially to one another by a dished cylindrical wall;

the cover comprises two discs, which are designed to be accommodated between the two fixed cheeks, and each comprise on their outer side mobile articulation means, which cooperate with the fixed articulation means, the two discs being connected to one another by a cylindrical envelope portion, which is designed to form the paper compartment which accommodates the rolled paper strip; and the mobile and fixed articulation means are designed to make the cover pivot between a position in which access to the paper compartment is open, and a position in which access to the paper compartment is closed.

A device of this type has the advantage that it has an integral articulation between the mobile and fixed parts of the frame, which limits the damage which can be caused by the portable payment terminal being dropped or banged.

In addition, by changing the diameter of the discs of the cover, it is possible to accommodate a paper strip with a selected diameter. Thus, it is easy to use paper strips with different diameters, by changing only the diameter of the discs.

According to another important characteristic of the invention, the device additionally comprises a latch, which is articulated around an axis which is parallel to the axis of articulation of the cover, and can cooperate with the cover and the fixed part of the frame, in order to provide locking/unlocking of the paper compartment on the fixed part of the frame.

A latch of this type makes it possible to keep the paper compartment locked, even when the user applies considerable force to the paper strip, when the strip is cut into sections.

According to a preferred embodiment of the invention, the latch comprises two lateral, flexible tabs, which are spaced from one another, parallel to one another, perpendicular to the axis of articulation of the latch, and are connected to one another by a bar which is parallel to the axis of articulation of the latch, the end of each tab comprising a flexible catch which can cooperate with a recess which is disposed in the fixed part of the frame, and articulation means which are mobile around the axis of articulation of the latch, and can cooperate with the two discs of the cover, in order to make the latch pivot into a position in which the tabs are spaced from the fixed frame, and a position in which the tabs are locked in the recesses of the fixed frame, in order to lock the cover positively into the fixed part of the frame.

In practice, each cheek of the fixed part of the frame comprises a notch which can cooperate with a tooth which is supported by the latch, in order to guide locking/unlocking of the said latch on the fixed part of the frame.

According to another aspect of the invention, on their outer side, the two discs each comprise an oblong indentation, which is splayed towards the periphery, and at the end of which there is disposed a pivot, and the latch additionally comprises two arms which are spaced from one another, parallel to one another, perpendicular to the axis of articulation of the latch, as well as to the plane of the tabs, and each comprise at their end an aperture which can cooperate with the pivot of the associated disc.

According to a preferred embodiment of the invention, the latch can support the drive roller for the rolled paper strip, and, in the locked position, the print head is supported resiliently on the drive roller, whereas in the unlocked position, the print head is spaced from the drive roller for the paper strip.

In practice, each tab is integral with a flexible lug, which can receive a clamping force which is designed to lock/unlock the catches of the tabs in their respective recesses.

Preferably, the latch comprises a detector for the presence of the paper strip in front of the print head.

Advantageously, the two discs of the cover each comprise on their cross-section a stop which is designed to cooperate with the cylindrical wall of the fixed frame, in order to distribute the forces along the entirety of the said wall.

Advantageously, each indentation of the disc comprises a stop, which can cooperate with an aperture provided on each arm, in order to permit pivoting of the latch, as well as pivoting of the cover.

According to an application of the printing device according to the invention, to a (plug-in or cordless) portable payment terminal, the fixed part of the frame can receive and accommodate the component elements of the said payment terminal, without securing means.

Advantageously, in the portable payment terminal application of the type which comprises a keypad with keys, the said keypad comprises a protective casing, with dimensions which are substantially adapted to those of the keypad, which is disposed in the vicinity of the said keypad, and comprises apertures with shapes which are substantially adapted to those of the keys, the said casing being articulated according to an axis which is parallel to the plane of the keypad, between an open position, in which the casing is spaced from the keypad, in order to form a protective screen during acquisition of data via the keys, and a position in which the protective casing covers the said keypad, the keys projecting through the apertures which are provided in the said casing.

A protective casing of this type makes it possible to protect the terminal user against indiscreet glances, when confidential data is being acquired via the keys.

In addition, the casing is detachable, which allows the non-perforated part to provide a new communication or personalisation vector for the portable payment terminal.

Other characteristics and advantages of the invention will become apparent from the following detailed description and drawings.

DETAILED DESCRIPTION OF THE PREFERRED EMBODIMENT

The drawings substantially comprise elements of a specific nature. Consequently they can contribute, not only towards improving understanding of the following detailed description, but also, as applicable, towards definition of the invention.

Figure 1:
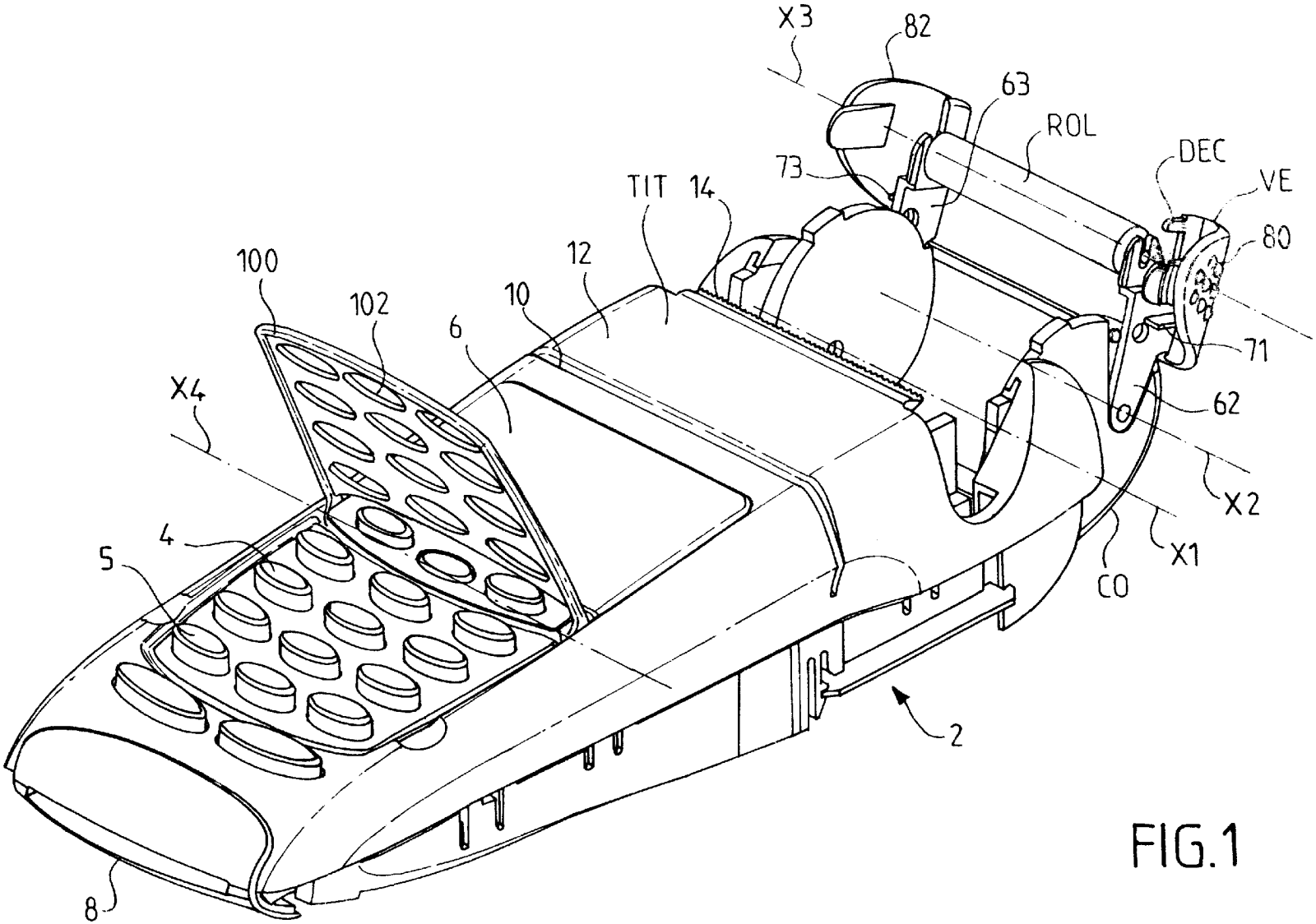
FIGS. 1 and 2 are perspective views of a portable payment terminal which is equipped with the thermal printing device according to the invention.
Figure 2:
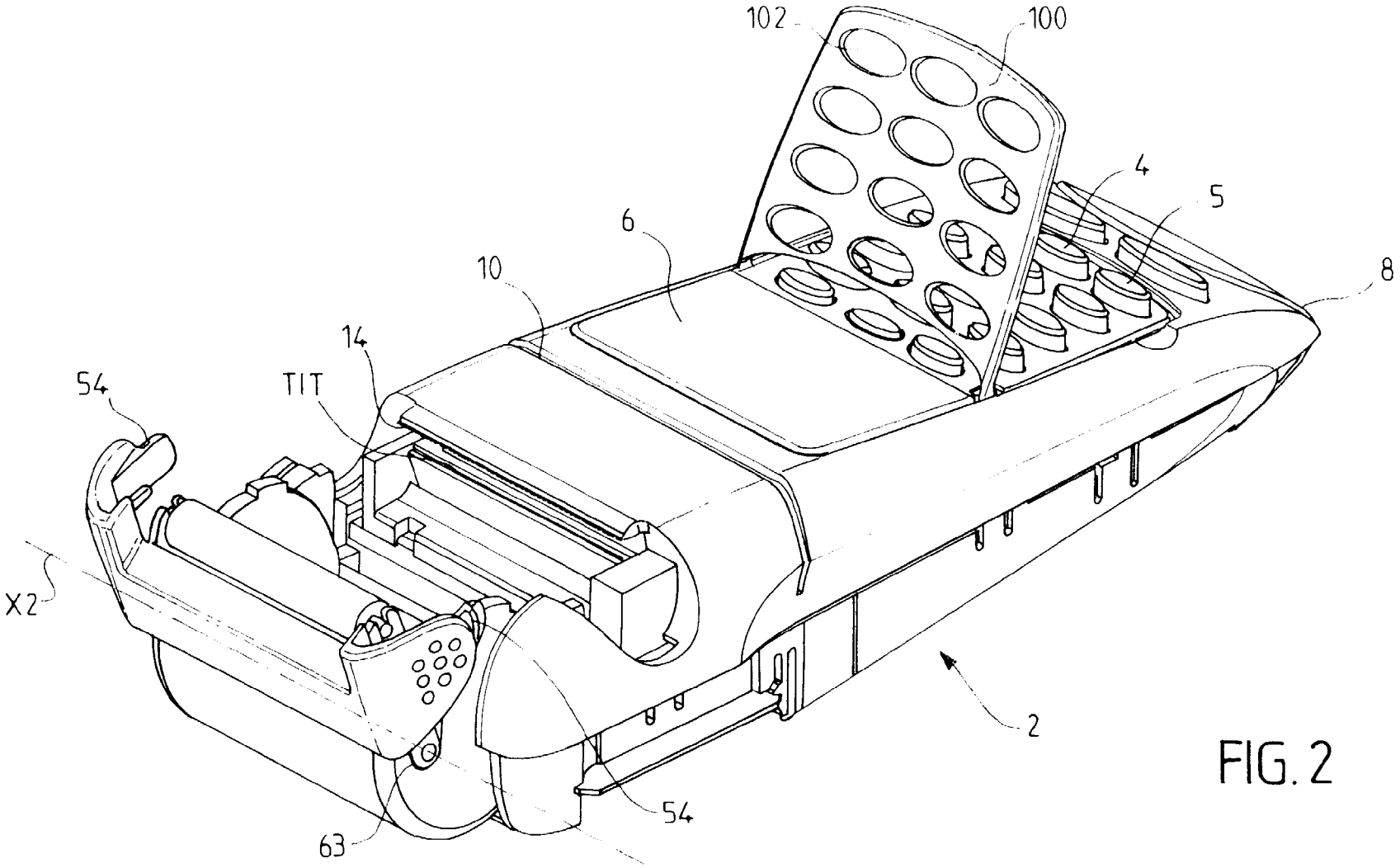

With reference to FIGS. 1 and 2, a (plug-in or cordless) portable-type payment terminal 2 comprises for example a keypad with keys 4, a display screen 6, a magnetic card processing unit 10, a thermal printing unit 12, and a memory card processing unit 8.

The terminal comprises a frame, which comprises a fixed part FIX, which is described in detail with reference to FIG. 5.

This fixed part FIX is designed to support the thermal print head TIT. The thermal print head TIT comprises for example a ceramic substrate, which supports a line of heating spots (not shown).

The terminal comprises a mobile part which forms a cover CO, for access to a paper compartment (described in detail with reference to FIG. 4). The mobile part is articulated around an axis X1, which is parallel to the drive axis X3 of the rolled paper strip. The roller paper strip is designed to be unwound in front of the thermal print head TIT by means of a paper drive roller ROL. After being printed, the strip is cut into sections, in order to form a payment authorisation or the like.

The fixed part FIX of the frame comprises a cutting device such as a cutting blade 14, of the toothed type, which is disposed parallel to the drive axis X3 of the rolled paper strip, in the vicinity of the thermal print head TIT, and downstream from the printing, in the direction of passage of the paper strip. The user of the portable terminal cuts the strip into sections, by placing the strip on the cutting blade, and pulling the strip in the direction of the width.

Figure 5:
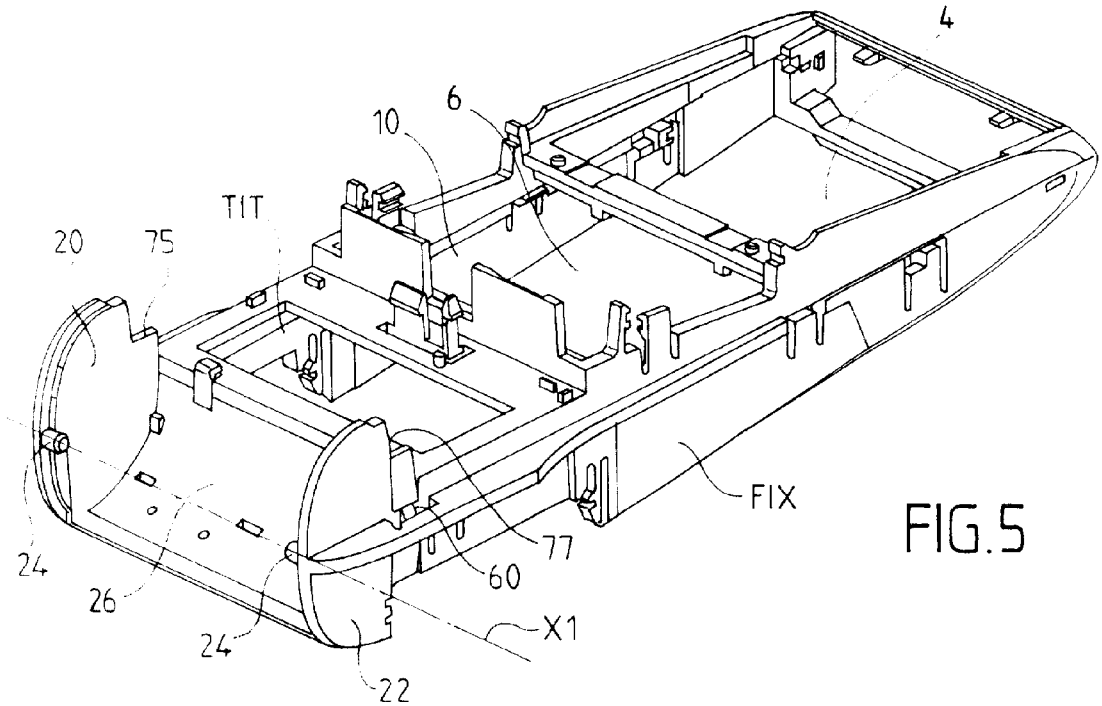
FIG. 5 is a perspective view of the fixed frame according to the invention.

With reference to FIG. 5, the fixed part FIX of the frame comprises two lateral cheeks 20 and 22, which are spaced from one another, parallel to one another, perpendicular to the axis of articulation Xl of the cover, and each comprise on their inner side fixed articulation means 24 (of the male hinge type). The two lateral cheeks 20 and 22 are connected partially to one another by a dished cylindrical wall 26.

Figure 8:
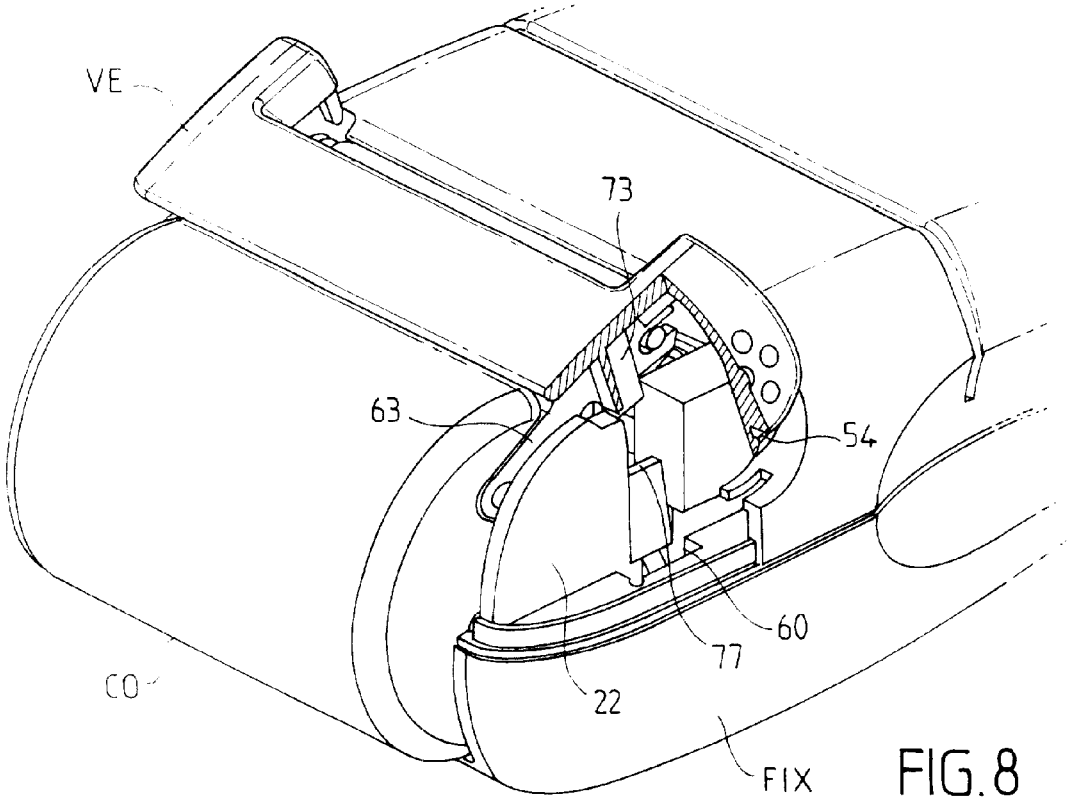
FIGS. 8, 9, 10 and 11 illustrate locking/unlocking of the latch, as well as pivoting of the cover according to the invention.
Figure 9:
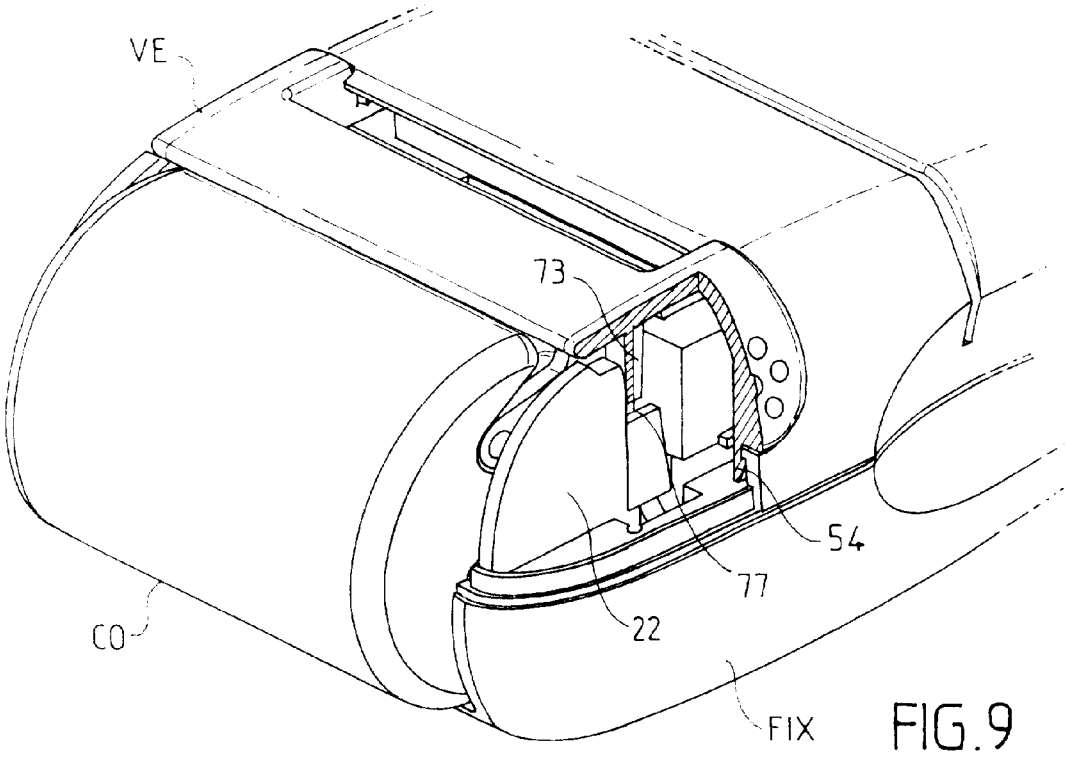

Each cheek 20 and 22 comprises a notch 75 and 77, which is designed to cooperate with a tooth 73 and 75, which is supported by a latch, which is described in greater detail hereinafter (FIGS. 8 and 9).

Figure 4:
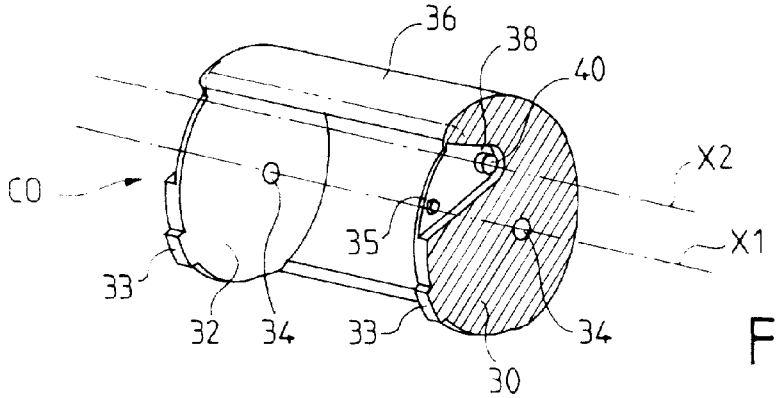
FIG. 4 is a perspective view of the cover according to the invention.

With reference to FIG. 4, the cover CO comprises two discs 30 and 32, which are designed to be accommodated between the two fixed cheeks 20 and 22. Each disc 30 and 32 comprises on its outer side mobile articulation means 34 (of the female hinge type, for example), which are designed to cooperate with the fixed articulation means 24 (of the male hinge type, for example).

The two discs 30 and 32 are connected to one another by a cylindrical envelope portion 36. This envelope 36 is designed to form the paper compartment, in order to accommodate the rolled paper strip.

The diameter of the discs is selected according to the diameter of the paper strip.

Advantageously, it is possible to select a disc diameter from amongst a plurality of diameters, according to the diameters of the paper strip used.

The mobile and fixed articulation means 34 and 24 (of the female/male hinge type) are disposed such as to make the cover CO pivot between a position in which access to the recess for the rolled paper strip is open, and a position in which access to the recess for the rolled paper strip is closed.

With reference to FIG. 4, the discs of the cover each comprise on their cross-section a stop 33, which is designed to cooperate with the cylindrical wall of the fixed frame 26, in order to distribute the forces along the entirety of the said wall.

A latch VE is articulated around an axis X2, which is parallel to the axis of articulation X1 of the cover. This latch VE cooperates with the cover CO and the fixed part of the frame FIX, in order to provide locking/unlocking of the paper strip compartment, on the fixed part of the frame.

Figure 3:
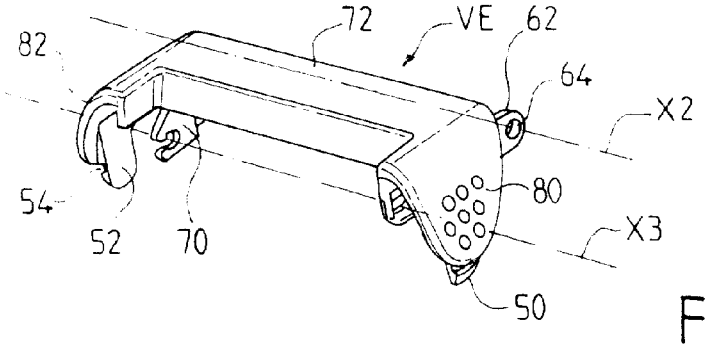
FIG. 3 is a perspective view of the latch according to the invention.

With reference to FIG. 3, the latch VE comprises two lateral tabs 50 and 52, which are flexible, spaced from one another, parallel to one another, and perpendicular to the axis of articulation X2 of the latch. The end of each tab comprises a catch 54, which can cooperate with a recess 60, which is disposed in the fixed part of the frame, and is adapted to the catch.

With reference to FIGS. 8 and 9, and to FIGS. 1 and 2, the latch additionally comprises two teeth 71 and 73, which are designed to cooperate with the notches 75 and 73 of the fixed part of the frame. These teeth are brought into the vicinity of the tabs 50 and 52. The shape of the teeth is adapted to that of the notches, in order to guide the positioning of the latch in the fixed part of the frame (FIGS. 8 and 9).

The latch VE additionally comprises articulation means 64, which are mobile around the axis of articulation X2 of the latch, and can cooperate with mobile articulation means 40, which are supported by the two discs of the cover CO, in order to make the latch VE pivot into a position in which the tabs are spaced from the fixed frame, and a position in which the tabs are locked in the recesses of the fixed frame, in order to unlock the cover on the fixed part of the frame.

In practice, the two discs 30 and 32 each comprise on their outer side an oblong indentation 38, which is splayed towards the periphery, and at the end of which there is disposed a pivot 40.

Accordingly, the latch VE comprises two arms 62 and 63, which are spaced from one another, parallel to one another, and perpendicular to the axis of articulation X2 of the latch, as well as to the plane of the tabs. At its end, each arm comprises an aperture 64, which can cooperate with the pivot 40 of the associated disc (FIG. 11).

According to another aspect of the terminal, the latch VE can support the drive roller for the strip ROL, by means of support means 70, which are disposed in the extension of the arms 60.

In the locked position, the print head TIT is supported resiliently on the drive roller ROL, whereas in the unlocked position, the print head TIT is spaced from the drive roller ROL.

Figure 11:
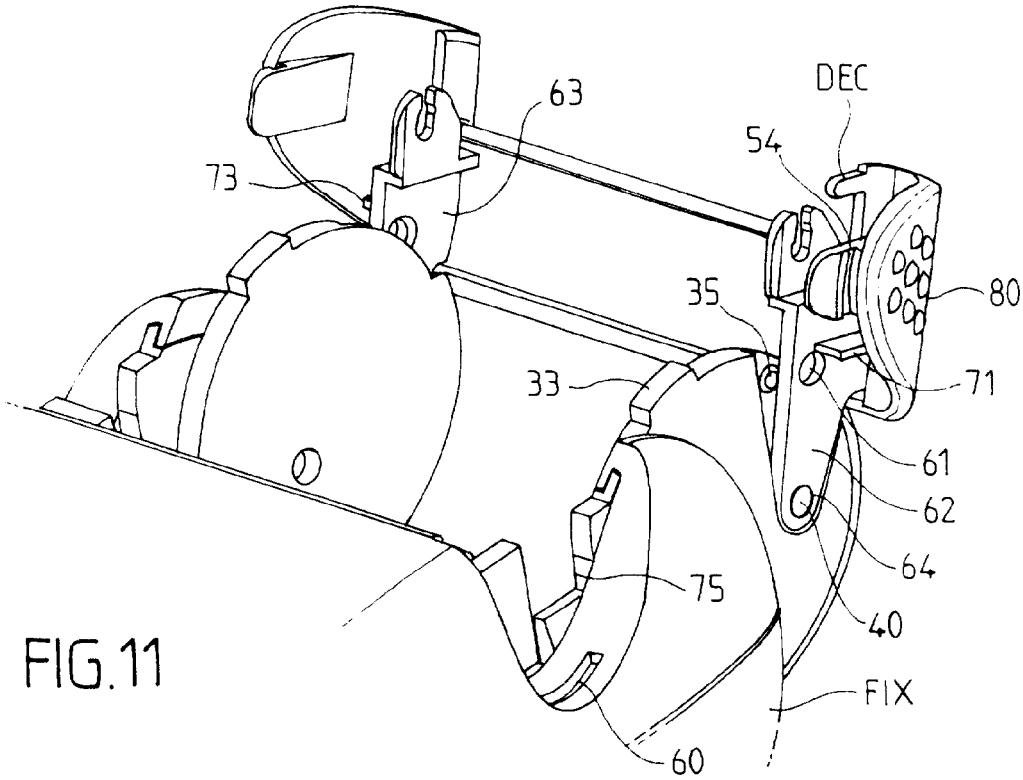

With reference to FIGS. 1 and 11, the latch VE comprises a detector DEC for the presence of the paper roll or of paper, in front of the print head TIT.

In the absence of paper in front of the print head, the functioning of the latter is inhibited in order to avoid damaging the heating elements of the head.

Figure 10:
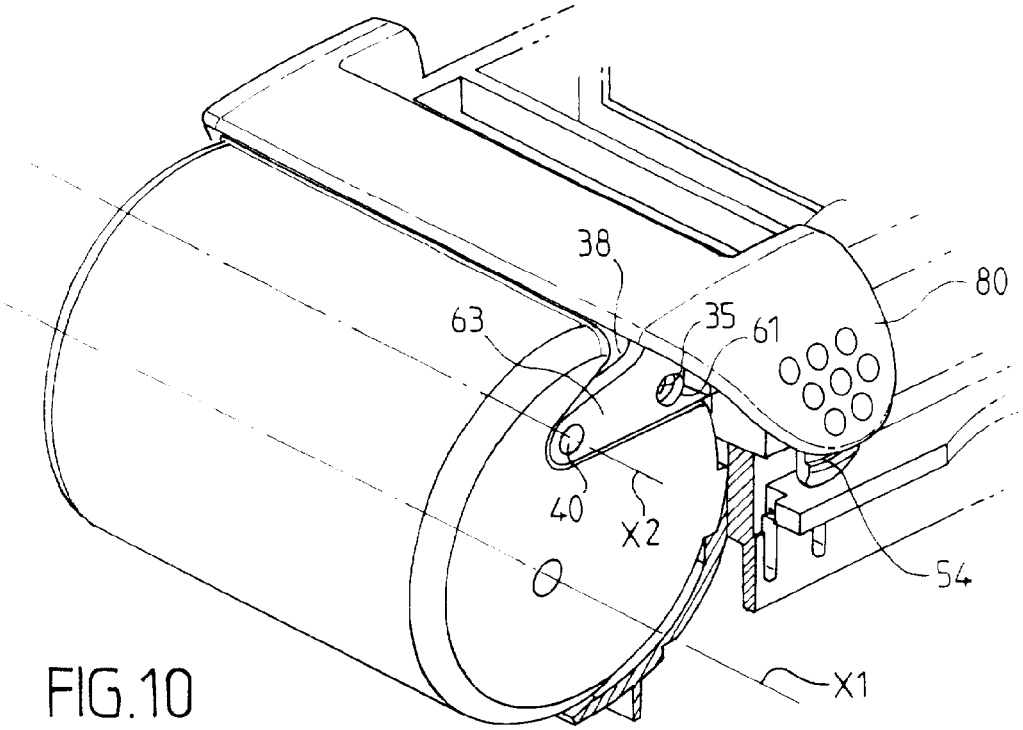

Each tab 50 and 52 is integral with a flexible lug 80, 82, which can receive a clamping/release force, which is designed to lock/unlock the catches 54 of the tabs, in their respective recesses 60 (FIG. 10).

With reference to FIGS. 4 and 10, each recess 38 comprises a stop 35, which can cooperate with an aperture 61 provided on each arm, in order to permit pivoting of the latch and the cover.

With reference to FIG. 8, the latch VE is in an unlocked position, with the teeth 71 and 73 in the vicinity of the notches 75 and 77. The catches 54 of the tabs are free. The arms 62 and 63 are in a free position in the indentations 38, i.e. the stops 35 are not in the apertures 61.

With reference to FIG. 9, the latch is in the locked position, with the teeth 71 and 73 accommodated in their respective indentations 75 and 77. The catches 54 are in their respective recesses 60.

With reference to FIG. 10, the latch is also in the locked position, in which the arms 62 and 63 are locked in the indentations 38, the stops 35 being accommodated in the apertures 61.

Figure 6:
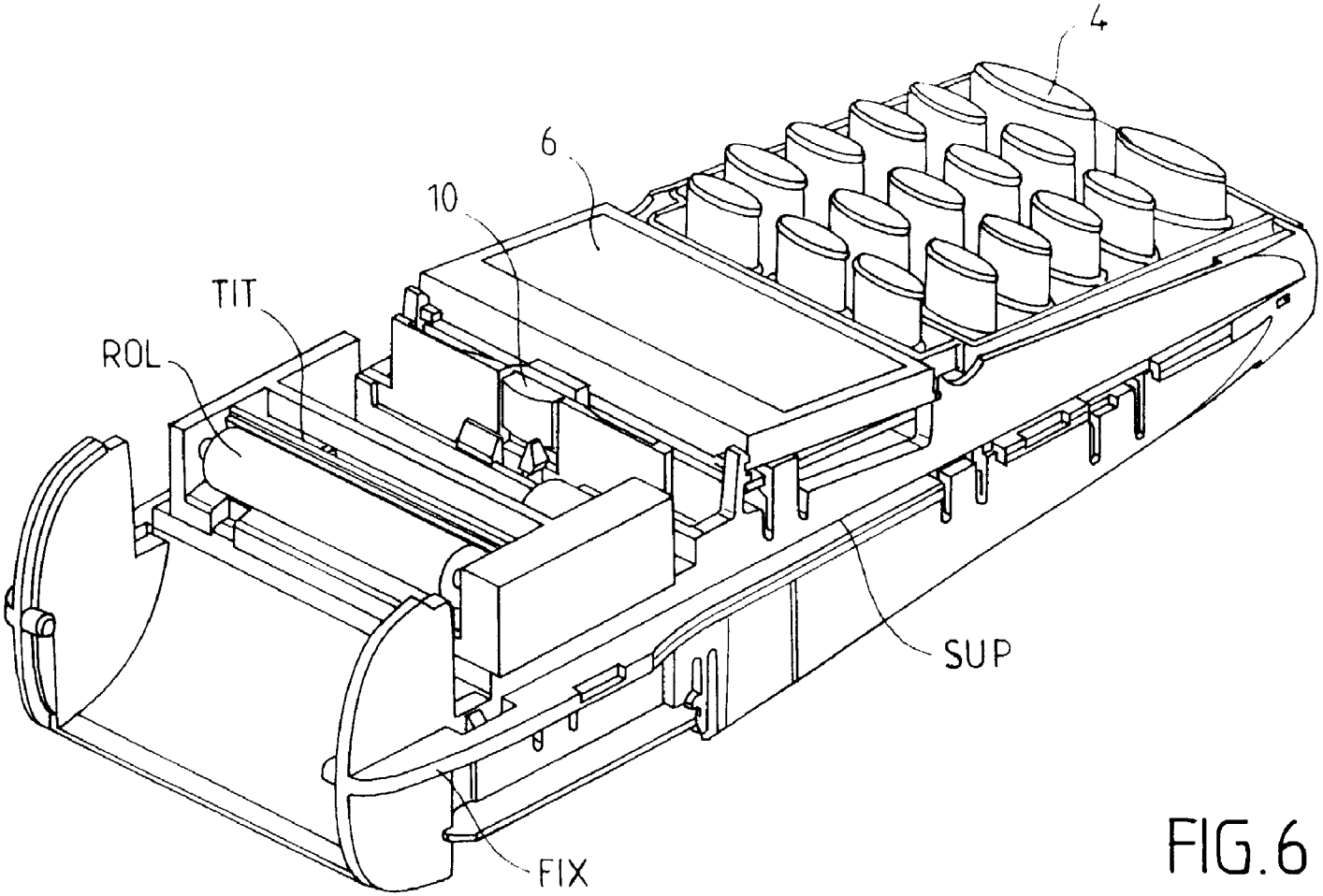
FIG. 6 is a perspective view which illustrates the accommodation of the elements of a portable payment terminal, on the upper surface of the frame according to the invention.
Figure 7:
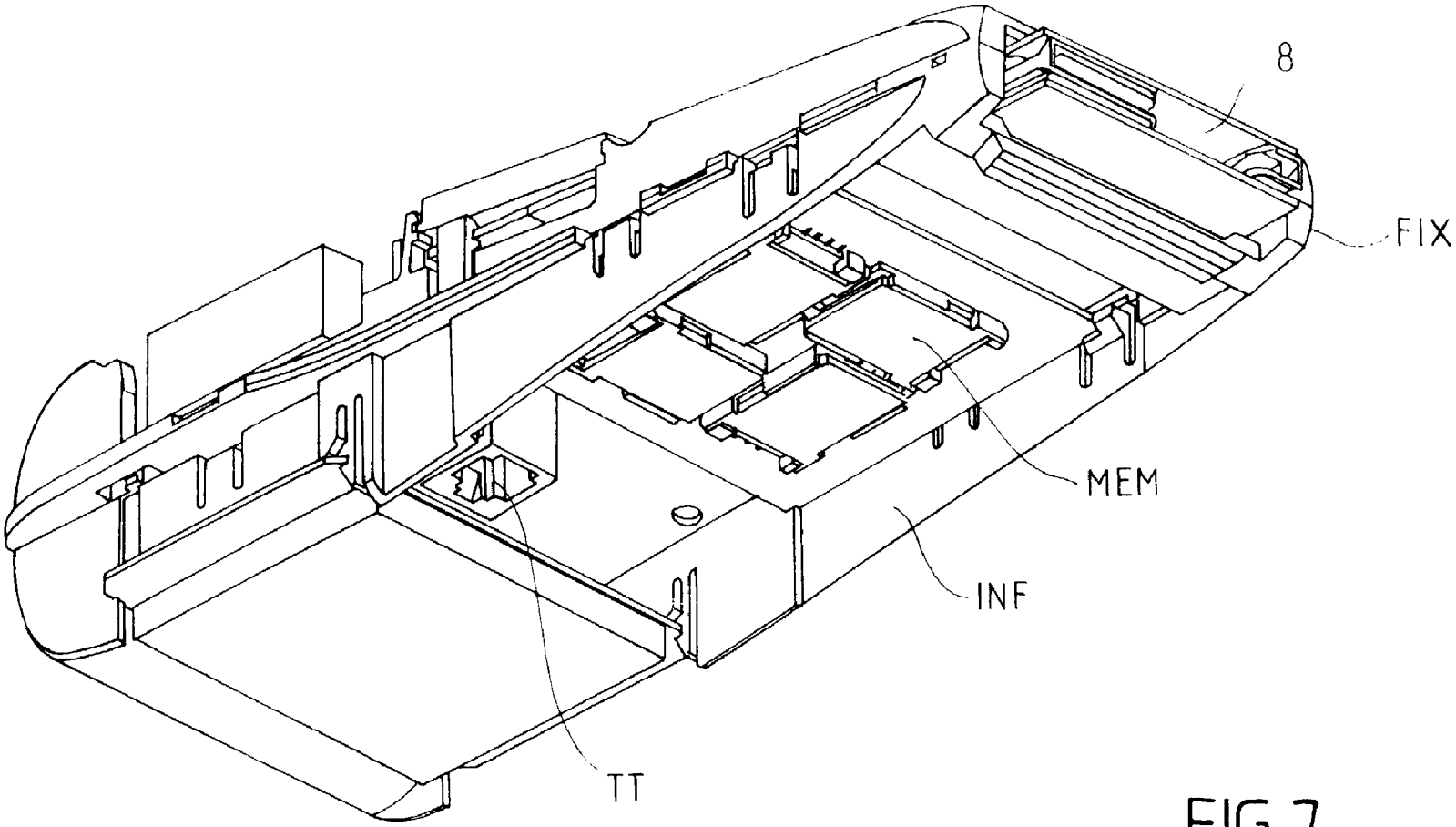
FIG. 7 is a perspective view which illustrates the accommodation of the component elements of a payment terminal, on the lower surface of the fixed frame according to the invention.

With reference to FIGS. 6 and 7, the fixed part of the frame FIX can receive and accommodate the component elements of a portable payment terminal, without securing means.

With reference to FIG. 6, the upper part SUP of the fixed frame FIX can support, without securing means, the keypad 4, the display unit 6, the magnetic processing unit 10, and the thermal print head TIT.

With reference to FIG. 7, the lower part INF of the fixed frame FIX can support, without securing means, extension means such as processing memories MEM, test means TT, or memory card readers of the SAM (Secured Access Module) type.

The chip card processing means 8 are accommodated between the upper part SUP, and the lower part INF, of the fixed frame FIX.

With reference to FIGS. 1 and 2, the portable payment terminal comprises a keypad 4, which comprises a protective casing 100, with dimensions which are substantially adapted to those of the keypad, which is disposed in the vicinity of the said keypad, and comprises apertures 102, with a shape which is substantially adapted to that of the keys 5 of the keypad.

The casing 100 is articulated according to an axis X4, which is parallel to the plane of the keypad, in an open position in which the casing is spaced from the keypad, and a position in which the protective casing covers the keypad, the keys 4 then projecting through the apertures 102 provided in the casing.

In the raised position, a casing of this type makes it possible to protect the user of the terminal against indiscreet glances, when confidential data is being acquired via the keys.

The casing 100 can be detached.

In addition, the non-perforated part can be the data support, in order to constitute a communication or personalisation vector for the portable payment terminal.

What is claimed is:

1. In a device for thermal printing of a rolled paper strip, in particular for a portable payment terminal, the said paper strip being designed to be unwound in front of a thermal print head by means of a paper drive roller, and to be cut into sections in order to form a payment authorisation or the like, the device being of the type which comprise a frame, which comprises a fixed part, which can support the thermal print head, and a mobile part which forms a cover for access to a paper compartment, and is articulated around an axis which is parallel to the drive axis of the rolled paper strip, the improvement wherein the fixed part of the frame comprises two lateral cheeks, which are spaced from one another, parallel to one another, perpendicular to the axis of articulation of the cover, and each comprise on their inner side fixed articulation means, the two lateral cheeks being connected partially to one another by a dished cylindrical wall;

wherein the cover comprises two discs, which are designed to be accommodated between the two fixed cheeks, and each comprise on their outer side mobile articulation means, which cooperate with the fixed articulation means, the two discs being connected to one another by a cylindrical envelope portion, which is designed to form the paper compartment; and wherein the mobile and fixed articulation means are designed to make the cover pivot between an open position, in which access to the paper compartment is open, and a closed position, in which access to the paper compartment is closed.

2. The improvement according to claim 1, additionally comprising a latch, which is articulated around an axis which is parallel to the axis of articulation of the cover, and can cooperate with the cover and the fixed part of the frame, in order to provide locking/unlocking of the paper compartment on the fixed part of the frame.

3. The improvement according to claim 2, wherein the latch comprises:

two lateral, flexible tabs, which are spaced from one another, parallel to one another, perpendicular to the axis of articulation of the latch, and are connected to one another by a bar, which is parallel to the axis of articulation of the latch, the end of each tab comprising a catch which can cooperate with a recess which is disposed in the fixed part of the frame;

articulation means which are mobile around the axis of articulation of the latch, and can cooperate with articulation means supported by the two discs of the cover, in order to make the latch pivot into a position in which the tabs are spaced from the fixed frame, and a position in which the tabs are locked in the recesses of the fixed frame, in order to lock the cover on the fixed frame.

4. The improvement according to claim 3, wherein each cheek of the fixed part of the frame comprises a notch which can cooperate with a tooth which is supported by the latch, in order to guide locking/unlocking of the said latch on the fixed part of the frame.

5. The improvement according to claim 3, wherein on their outer side, the two discs each comprise an oblong indentation, which is splayed towards the periphery, and at the end of which there is disposed a pivot, and in that the latch additionally comprises two arms, which are spaced from one another, parallel to one another, perpendicular to the axis of articulation of the latch, as well as to the plane of the tabs, and each comprise at their end an aperture which can cooperate with the pivot of the associated disc.

6. The improvement according to claim 2, wherein the latch can support the drive roller for the rolled paper strip, and that in the locked position, the print head is supported resiliently on the drive roller, whereas in the unlocked position, the print head is spaced from the drive roller for the paper strip.

7. The improvement according to claim 3, wherein each tab is integral with a flexible lug, which can receive a clamping/release force which is designed to lock/unlock the catches of the tabs in their respective recesses.

8. The improvement according to claim 1, wherein the latch comprises a detector for the presence of the paper strip in front of the print head.

9. The improvement according to claim 1, wherein the discs of the cover each comprise on their cross-section a stop, which is designed to cooperate with the cylindrical wall of the fixed frame, in order to distribute the forces along the entirety of the said wall.

10. The improvement according to claim 5, wherein each indentation comprises a stop, which can cooperate with an aperture provided in each arm, in order to permit pivoting of the latch and of the cover.

11. The improvement according to claim 1, wherein the fixed part of the frame can receive and accommodate the component elements of a portable payment terminal, without securing means.

12. The improvement according to claim 11, wherein a keypad comprises a protective casing, with dimensions which are substantially adapted to those of the keypad, which is disposed in the vicinity of the said keypad, and comprises apertures with shapes which are substantially adapted to those of the keys, the said casing being articulated according to an axis which is parallel to the plane of the keypad, between an open position, in which the casing is spaced from the keypad, and a position in which the protective casing covers the said keypad, the keys projecting through the apertures which are provided in the said casing.

13. The improvement according to claim 12, wherein the protective casing is detachable.

* * * * *